US009233373B2

(12) United States Patent
Kümmlee et al.

(10) Patent No.: US 9,233,373 B2
(45) Date of Patent: Jan. 12, 2016

(54) TUBE MILL

(75) Inventors: Horst Kümmlee, Berlin (DE); Peter Petereit, Berlin (DE); Frank Seibicke, Borkheide (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 351 days.

(21) Appl. No.: 13/981,566

(22) PCT Filed: Jan. 25, 2011

(86) PCT No.: PCT/EP2011/050950

§ 371 (c)(1),
(2), (4) Date: Jul. 24, 2013

(87) PCT Pub. No.: WO2012/100818

PCT Pub. Date: Aug. 2, 2012

(65) Prior Publication Data

US 2013/0306773 A1 Nov. 21, 2013

(51) Int. Cl.
*B02C 17/24* (2006.01)

(52) U.S. Cl.
CPC ..... *B02C 17/24* (2013.01)

(58) Field of Classification Search
CPC ..... B02C 17/24
USPC ..... 241/170, 176, 179, 299, 285.1
See application file for complete search history.

(56) References Cited

U.S. PATENT DOCUMENTS

| | | | | |
|---|---|---|---|---|
| 1,458,120 | A | 6/1923 | Williamson | |
| 3,903,439 | A * | 9/1975 | Kartman | B02C 17/24 241/176 |
| 6,655,617 | B2 * | 12/2003 | Hagedorn | B02C 17/24 241/170 |
| 6,719,227 | B2 * | 4/2004 | Scuccato | B02C 17/24 241/176 |
| 7,482,720 | B2 | 1/2009 | Gordon et al. | |
| 8,129,881 | B2 | 3/2012 | Hösle | |
| 2009/0091203 | A1 | 4/2009 | Petereit et al. | |
| 2009/0127985 | A1 | 5/2009 | Hoffmann et al. | |
| 2009/0302698 | A1 | 12/2009 | Menz et al. | |
| 2010/0033035 | A1 | 2/2010 | Hösle | |

FOREIGN PATENT DOCUMENTS

| | | | |
|---|---|---|---|
| CM | 1539191 | A | 10/2004 |
| CN | 2150662 | Y | 12/1993 |
| CN | 101442237 | A | 5/2009 |
| CN | 101610849 | A | 12/2009 |
| DE | 1 179 629 | | 10/1964 |
| DE | 102007005131 | | 1/2008 |
| JP | 7023541 | A | 2/1995 |
| JP | 2006149020 | A | 6/2006 |

OTHER PUBLICATIONS

International Search Report issued by the European Patent Office in International Application PCT/EP2011/050950 on Oct. 11, 2011.

* cited by examiner

*Primary Examiner* — Faye Francis
(74) *Attorney, Agent, or Firm* — Henry M. Feiereisen LLC

(57) ABSTRACT

A tube mill has a body arranged for rotation about an axis of rotation. Material to be ground can be introduced into the body for comminution. The tube mill has an electric motor for rotationally driving the body. The electric motor has a rotor arranged around the body and connected to the body for rotation therewith and has a stator arranged stationarily around the rotor. The tube mill has a concrete element running around at least half the circumference of the stator yoke which is connected to the concrete element in such a way that forces acting on the stator yoke are transferred to the concrete element.

8 Claims, 6 Drawing Sheets

TUBE MILL

CROSS-REFERENCES TO RELATED APPLICATIONS

This application is the U.S. National Stage of International Application No. PCT/EP2011/050950, filed Jan. 25, 2011, which designated the United States and has been published as International Publication No. WO 2012/100818.

BACKGROUND OF THE INVENTION

The invention relates to a tube mill. Tube mills are frequently used to comminute material such as lumps of ore, for example. In tube mills, the material to be ground is placed in a tubular, rotatably arranged body and, as the body rotates, the material is pulverized either by its own gravity or by adding grinding elements such as balls, for example. The axis of rotation of the body has a horizontal orientation.

In tube mills, production throughput depends essentially on the diameter of the body. Smaller tube mills are customarily driven via gearboxes and suitable electric motors. In the case of larger tube mills, it is uneconomic to use gearbox solutions to drive the body owing to wear. Larger tube mills are therefore driven via a so-called wrap-around (ring) motor which is arranged around the body like an upright ring and drives the body directly, i.e. gearlessly, in a rotary manner. In this case there is an air gap of only a few millimeters between the rotor and stator yoke of the wrap-around motor. In order to ensure safe and reliable operation of the wrap-around motor, there must be no mechanical contact between the rotor and stator yoke of the wrap-around motor and therefore no severe vibrations of the stator yoke of the wrap-around motor during operation of the tube mill.

SUMMARY OF THE INVENTION

For an electric motor disposed around the body of the tube mill and driving the body of the tube mill, the object of the invention is to reduce vibrations of the stator yoke of the electric motor that occur during operation of the electric motor.

This object is achieved by a tube mill, wherein the tube mill has a body disposed so as to rotate about an axis of rotation, wherein material to be ground can be introduced into the body for comminution, wherein the tube mill has an electric motor for rotationally driving the body, wherein the electric motor has a rotor disposed around and co-rotationally connected to the body, and a stator yoke disposed stationarily around the rotor, wherein the tube mill has a concrete element running around at least half the circumference of the stator yoke, wherein the stator yoke is connected to the concrete element such that forces acting on the stator yoke are transferred to the concrete element.

For an electric motor disposed around the body of the tube mill and driving the body of the tube mill, the invention also enables deformations of the stator yoke of the electric motor that occur during operation of the electric motor to be reduced. In addition, the invention also enables static deformations of the stator yoke to be reduced.

As the concrete element can also be poured from concrete at the desired installation site of the tube mill, very large tube mills can be implemented and assembled in a simple manner at the installation site.

Advantageous embodiments of the invention will emerge from the dependent claims.

It is found to be advantageous for the concrete element to consist of a plurality of segments, as this enables the concrete element to be easily assembled from the segments at the installation site of the tube mill. For this purpose the segments are interconnected, e.g. bolted together.

It is also found advantageous for the concrete element to be embodied in a single piece, as the concrete element is then particularly stable and resilient.

It is also found advantageous for the concrete element to run around at least three quarters of the circumference of the stator yoke, as the vibrations of the stator yoke are then greatly reduced.

It is also found advantageous for the concrete element to run around the entire circumference of the stator yoke, as the vibrations of the stator yoke are then particularly greatly reduced.

It is additionally found advantageous for the radially running distance from the concrete element to the axis of rotation to be constant, as the vibrations of the stator yoke are then particularly greatly reduced.

It is also found advantageous for ducts to be disposed in the concrete element for cooling the wrap-around motor, as the electric motor is then particularly effectively cooled.

The invention is found to be advantageous particularly for large tube mills, i.e. tube mills whose driving electric motor has a power output of greater than 5 MW.

BRIEF DESCRIPTION OF THE DRAWING

An exemplary embodiment of the invention will now be explained in greater detail with reference to the accompanying drawing, in which.

DETAILED DESCRIPTION OF PREFERRED EMBODIMENTS

Figure 1:
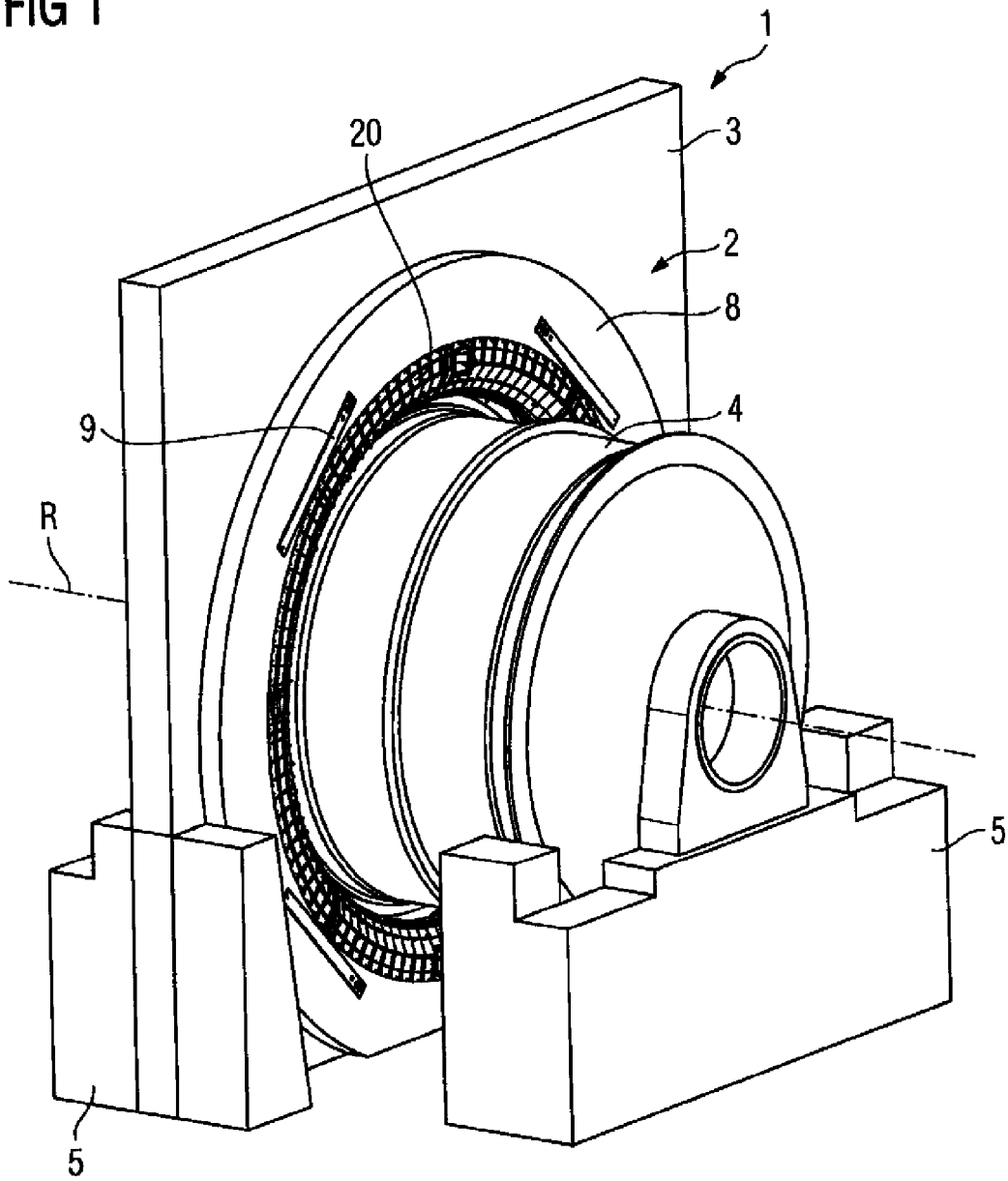
FIG. 1 shows a rear view of the tube mill according to the invention.
Figure 2:
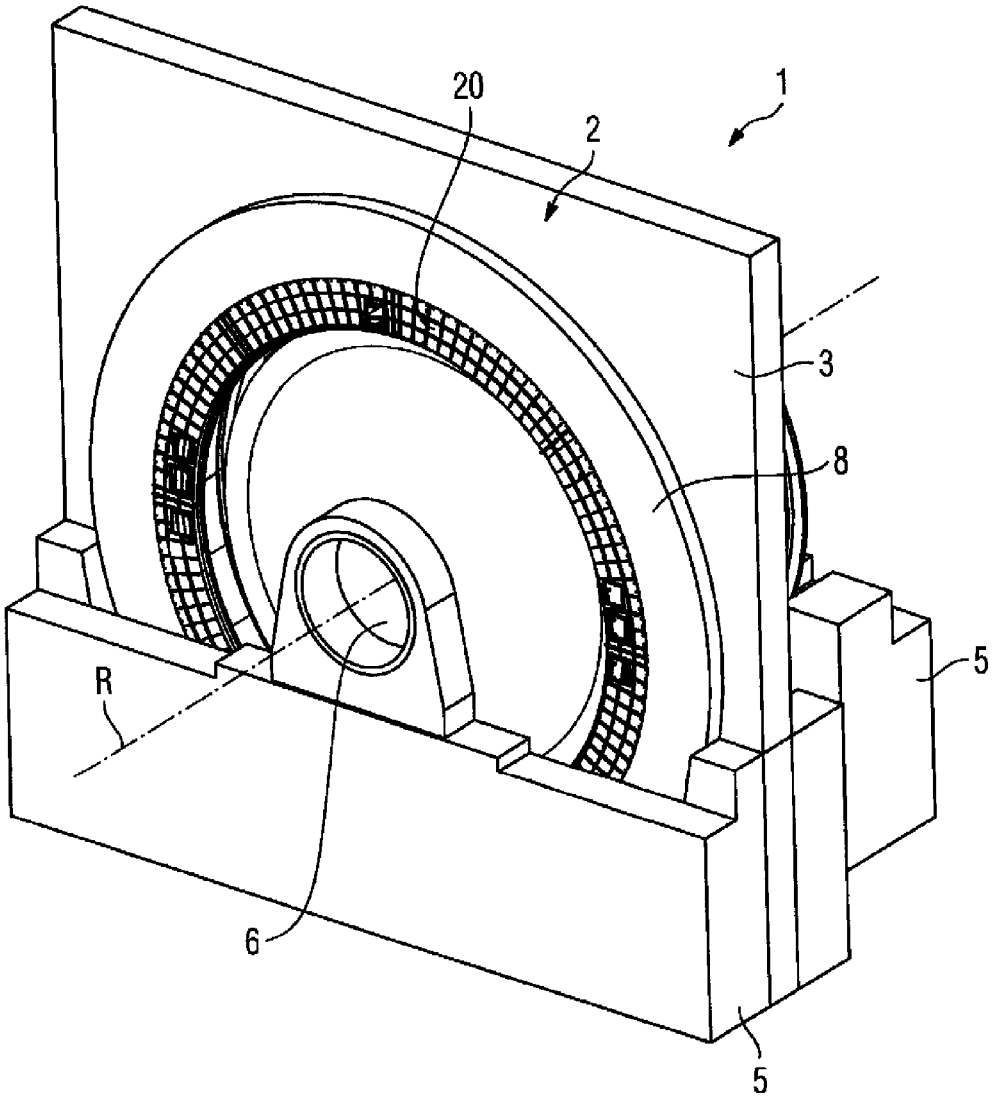
FIG. 2 shows a front view of the tube mill according to the invention.

FIG. 1 shows a rear view of the tube mill 1 according to the invention in a schematized perspective representation. The tube mill 1 has a tubular body 4 disposed so as to be rotatable about an axis of rotation R, wherein the axis of rotation R has a horizontal orientation. FIG. 2 shows a front view of the tube mill 1 according to the invention in a schematized perspective representation. In FIG. 2, identical elements are labeled with the same reference characters as in FIG. 1.

Material to be comminuted can be fed into the body 4 via an opening 6. To drive the body 4 in a rotating manner, the tube mill 1 has an electric motor 2 which rotationally drives the body 4 directly, i.e. without a gearbox connected intermediately between electric motor 2 and body 4, and is embodied as a wrap-around motor.

The electric motor 2 has a housing 8 and winding shields 20. The electric motor 2 also has coolers, wherein for clarity of illustration reasons only one cooler 9 is labeled with a reference character in FIG. 1. The tube mill 1 according to the invention additionally has support elements 5 on which the body 4 is rotatably mounted.

The electric motor 2 has a stationarily disposed stator which comprises the essential stationary elements of the electric motor 2 and a rotor which comprises the elements of the electric motor 2 that rotate about the axis of rotation R. In the context of the exemplary embodiment, the essential elements of the stator are fixed directly or indirectly to a concrete element 3.

Figure 3:
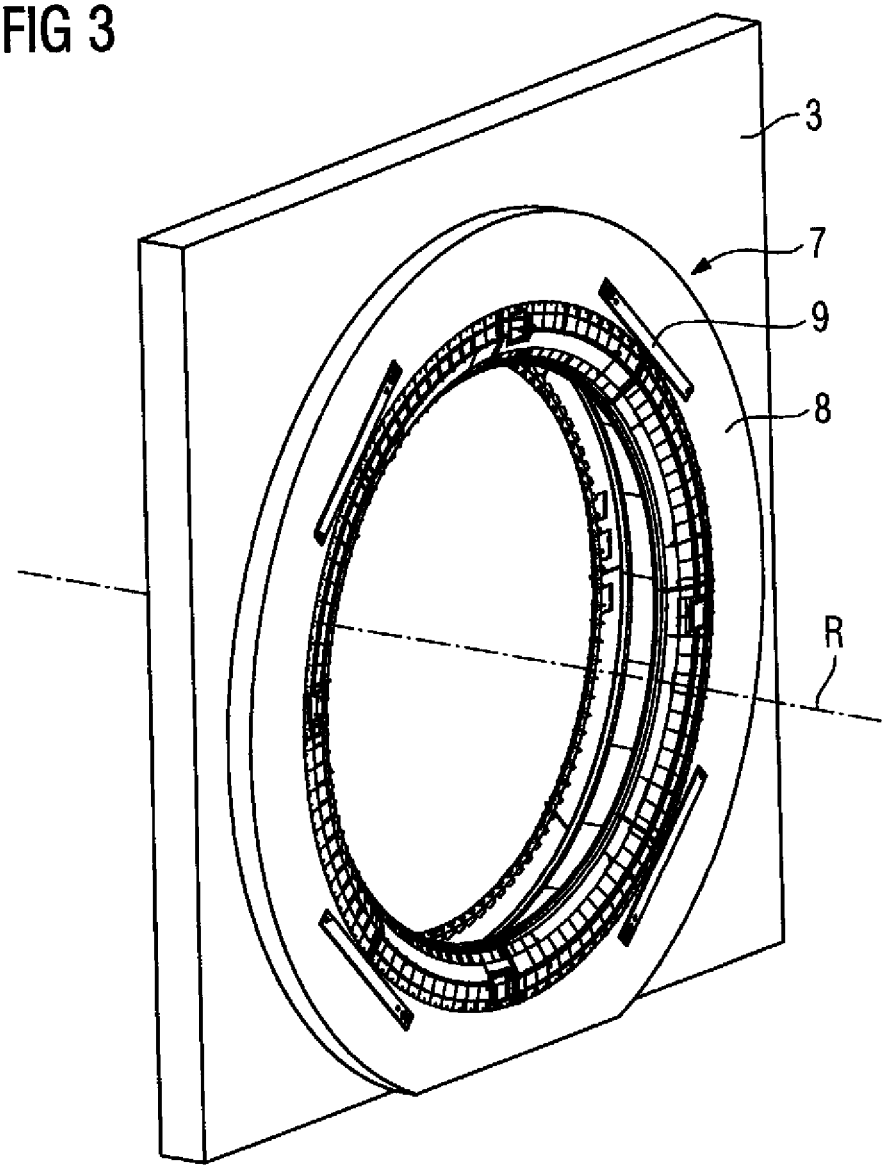
FIG. 3 shows a concrete element and a stator of the electric motor.

In FIG. 3, the concrete element 3 and the stator 7 of the electric motor 2 are shown in the form of a schematized perspective view. In FIG. 3, identical elements are labeled with the same reference characters as in FIG. 1 and FIG. 2.

Figure 4:
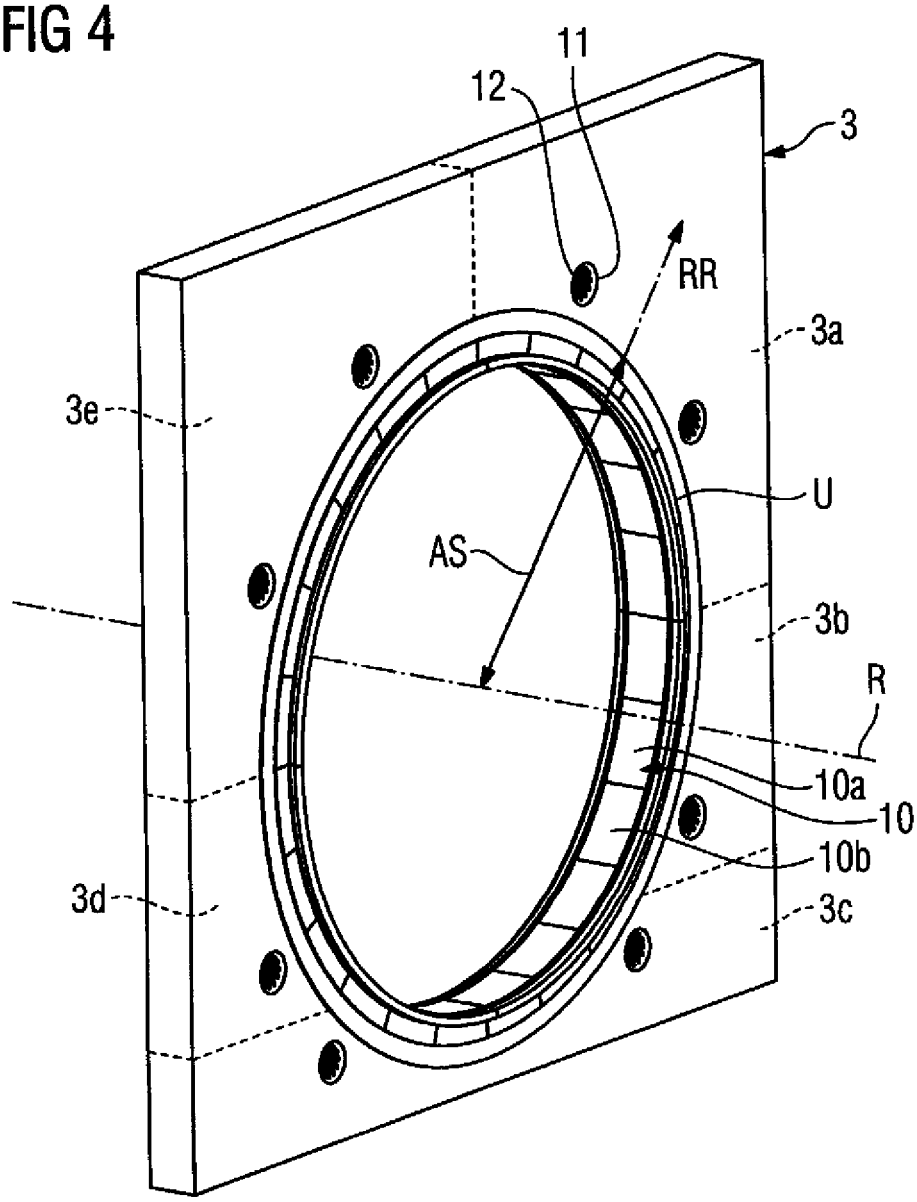
FIG. 4 shows a concrete element and a stator yoke of the electric motor.

In FIG. 4, the concrete element 3 and the stator 7 of the electric motor 2 are shown in the form of a schematized perspective view without the housing 8, cooler 9 and winding shields 20. The stator 7 of the electric motor 2 has an annular stator yoke 10 as an essential element. In the context of the exemplary embodiment, the stator yoke 10 consists of stator yoke segments, wherein for clarity of illustration reasons only two stator yoke segments 10*a* and 10*b* are labeled with a reference character. The stator yoke segments are assembled to form the annular stator yoke 10.

In FIG. 4, the circumference of the stator yoke 10 is designated by the reference character U. The stator yoke 10 can be embodied as a solid structure or else consist, for example, of a series of plates electrically insulated from one another. The stator yoke 10 consists of a magnetically conductive material such as a ferromagnetic material (e.g. iron).

The stator yoke 10 has recesses in which a stator winding is disposed which for clarity of illustration reasons is not shown in FIG. 4. During operation of the electric motor 2, the stator winding generates a magnetic field which rotationally drives the rotor of the electric motor 2 and therefore the body 4 mounted on the rotor of the electric motor. During operation of the tube mill, forces are transmitted from the body to the rotor of the electric motor and from the rotor via the magnetic field acting between rotor and stator yoke to the stator yoke of the electric motor. These forces excite the stator yoke to vibrate, which in the worst-case scenario can cause the air gap disposed between rotor and stator of the electric motor to be bridged and the stator yoke to strike the rotor of the electric motor, which may result in damage or destruction of the rotor and the stator yoke. To reduce the vibrations, the tube mill 1 according to the invention has the concrete element 3 running round at least half the circumference U of the stator yoke 10, wherein the stator yoke 10 is connected to the concrete element 3 such that forces acting on the stator yoke 10 are transferred to the concrete element 3, thereby achieving a good reduction in the vibrations of the stator yoke.

Very good vibration reduction is achieved if the concrete element 3 is disposed so as to run round at least three-quarters of the circumference of the stator yoke. Optimum vibration reduction is achieved if, as shown in the exemplary embodiment, the concrete element 3 is disposed so as to run around the entire circumference U of the stator yoke 10. The distance AS running in the radial direction RR from the concrete element 3 to the axis of rotation R is preferably constant, i.e. the recess running through the concrete element for accommodating the stator yoke 10 preferably has a partially circular or circular shape.

As concrete structures exhibit higher material damping than all-steel structures, vibrations are reduced not only by the greater rigidity of the concrete but also by the better damping of the concrete.

The concrete element 3 consists of concrete or reinforced concrete. In the context of the exemplary embodiment the concrete element 3 is made of reinforced concrete, i.e. it has steel reinforcement disposed inside the concrete element.

During operation of the tube mill, the concrete element 3 absorbs the forces transmitted from the rotor of the electric motor to the stator yoke 10 and dissipates them into the ground. By means of the inventive concrete element 3 running around the stator yoke 10, a very rigid supporting structure preferably having a large mass is implemented which can absorb great forces without being excited into vibration.

The concrete element can be embodied in one piece as in the exemplary embodiment, or, as shown by the dashed lines in FIG. 4, can even be composed of a plurality of segments, wherein the segments can be e.g. bolted together. In FIG. 4, the boundaries of the segments 3*a*, 3*b*, 3*c* and 3*d*, 3*e* of which the concrete element 3 can consist, for example, are indicated by dashed lines.

To cool the electric motor 2, ducts running through the concrete element 3 are disposed in the concrete element 3. Fans are disposed in the ducts. For clarity of illustration reasons only one duct 11 and one fan 12 are labeled with reference characters in FIG. 4.

Figure 5:
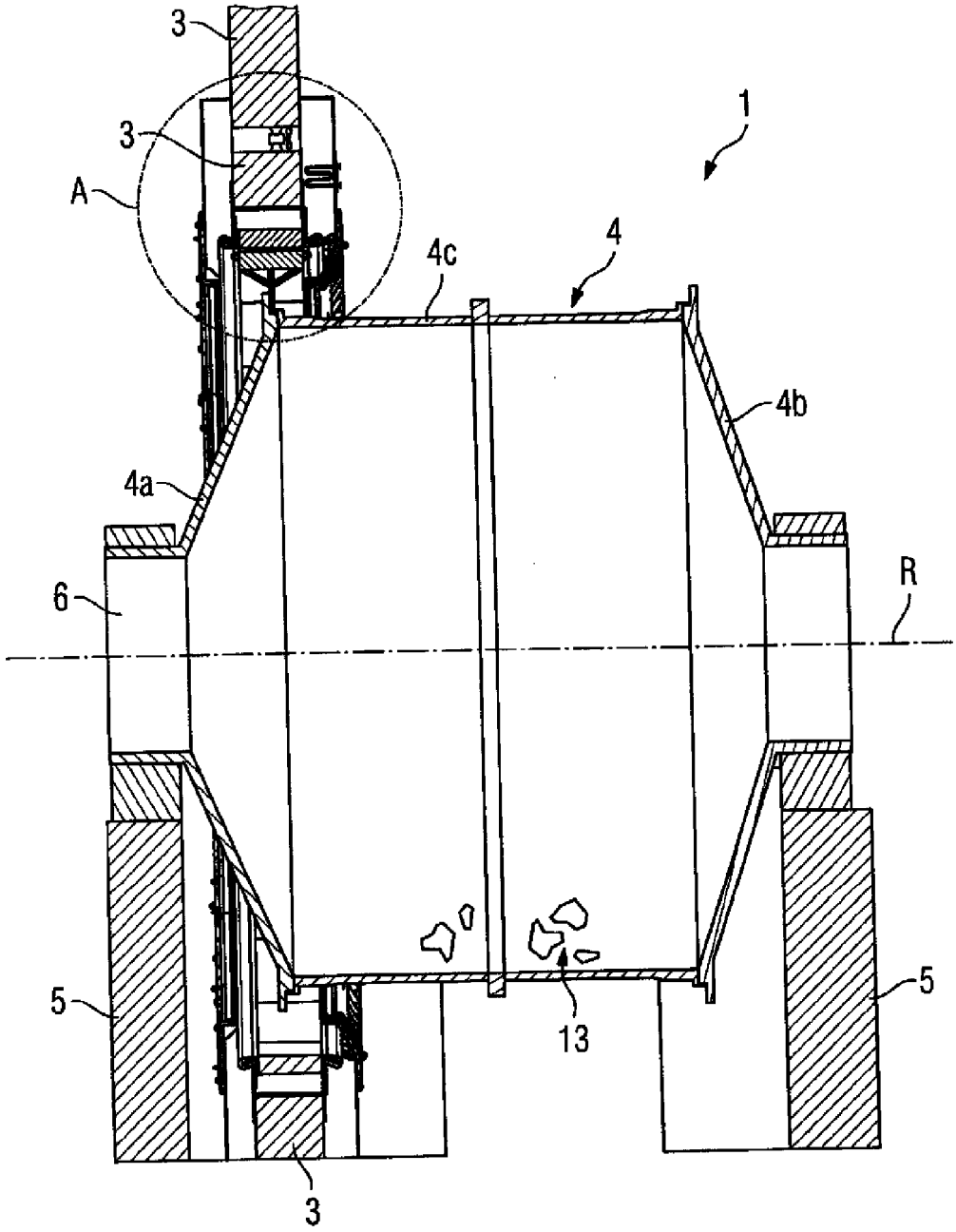
FIG. 5 shows a sectional view of the tube mill according to the invention.

FIG. 5 shows a section through the tube mill 1 according to the invention in the form of a schematized representation. Identical elements are labeled with the same reference characters as in FIG. 1 to FIG. 4. The body 4 has a lateral surface 4*c* and two funnel-shaped end sections 4*a* and 4*b*. Material to be ground can be fed into the body 4 e.g. through the opening 6.

Figure 6:
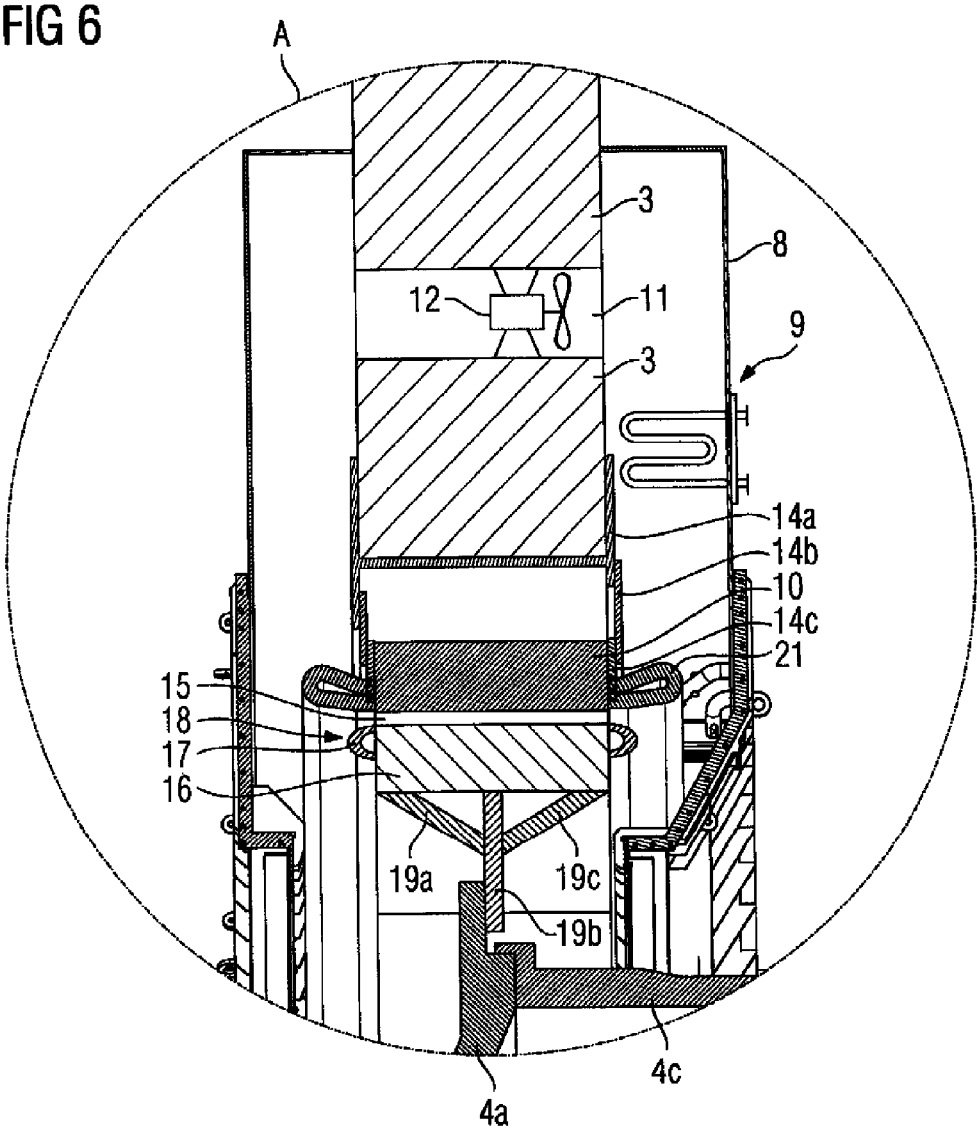
FIG. 6 shows an enlarged detail from FIG. 5.

In FIG. 6, the region marked A in FIG. 5 is shown enlarged. Identical elements are labeled with the same reference characters as in FIG. 1 to FIG. 5. It should be noted here that for clarity of illustration reasons the steel reinforcement of the concrete element 3 (reinforced concrete) disposed inside the concrete element 3 is not shown in FIG. 5 and FIG. 6.

In the context of the exemplary embodiment, the housing 8 of the electric motor 2 is likewise fastened to the concrete element 3. It should be noted here that in FIG. 6 the fan 12 and the cooler 9 are symbolically represented only in a very schematized manner. The external connections of the cooler 9 are connected to cooling lines via which a coolant is pumped through the cooler 9.

During operation of the fan 12, the air is moved by the electric motor 2 through the duct 3 and flows past the cooler 9, where it is cooled. The air is accordingly also pumped through the other ducts of the concrete element by means of the fans disposed in the ducts.

The stator yoke 10 is connected to the concrete element 3 such that forces acting on the stator yoke 10 are transferred to the concrete element 3. During operation of the tube mill 1, said forces are transferred from the rotor 18 to the stator yoke 10 via the magnetic field acting between rotor 18 and stator yoke 10 and from the stator yoke 10 to the concrete element 3. For this purpose the stator yoke 10 is mechanically connected directly or indirectly to the concrete element 3. If the stator yoke 10 is connected directly to the concrete element 3, the stator yoke 10 is directly fastened, e.g. bolted, to the concrete element. If the stator yoke 10 is indirectly connected to the concrete element 3, the stator yoke 10 is connected to the concrete element 3 via at least one fastener. Said fastener can be e.g. in the form of a steel ring disposed between stator yoke and concrete element, the stator yoke being fastened, e.g. bolted, to the steel ring and the steel ring being fastened, e.g. bolted, to the concrete element.

In the context of the exemplary embodiment the stator yoke 10 is fastened to the concrete element 3 via fasteners 14*a*, 14*b*, 14*c*. In the context of the exemplary embodiment, the fastener 14*a* is implemented as a steel ring running around the stator yoke 10 and fastened to the concrete element 3.

The stator yoke 10 has recesses in which a stator winding 21 is disposed, only the end turns of the stator winding 21 protruding laterally from the stator yoke 10 being visible in FIG. 6. The electric motor 2 additionally has a rotor 18 which comprises the elements of the electric motor 2 that rotate about the axis of rotation R. The essential element of the rotor 18 is a rotor yoke 16 which is made of a magnetically conductive material such as a ferromagnetic material, for example, and can be solid or made up of a series of plates electrically insulated from one another. The rotor yoke 16 has recesses in which a rotor winding 17 is disposed, only the end turns of the rotor winding 17 protruding laterally from the rotor yoke 16 being visible in FIG. 6. During operation of the electric motor, a current flows through the rotor winding 17 so that magnetic poles are created on the rotor yoke 16. The rotor yoke 16 is connected to the body 4 of the tube mill via fasteners 19*a*, 19*b*, 19*c*. The rotor yoke 16 of the rotor 18 is disposed around the circumference of the body 4. An air gap 15 is disposed between rotor 18 and stator yoke 10. The body 4 can be rotationally driven by a magnetic field acting between rotor 18 and stator yoke 10.

The rotor 18 is connected to the body 4 directly, i.e. without intermediate gearing. The electric motor 2 is therefore embodied as a so-called wrap-around (ring) motor.

It should be noted at this point that for clarity of illustration reasons the bolted or welded connections implemented between the individual elements of the tube mill for connecting the individual elements are not shown.

It should also be noted that the concrete element need not necessarily, as in the exemplary embodiment, have a rectangular outside contour, but can have any outside contour.

It should also be noted that further components of the tube mill, such as e.g. converters, oil supply units, etc., can also be disposed on the concrete element or in recesses of the concrete element.

What is claimed is:

1. A tube mill, comprising:

a body disposed for rotation about an axis of rotation and receiving material to be ground for comminution;

an electric motor for rotationally driving the body, said electric motor having a rotor disposed around the body in fixed rotative engagement with the body, and a stator yoke disposed stationarily around the rotor; and a concrete element running around at least half a circumference of the stator yoke, said stator yoke being connected to the concrete element such that a force acting on the stator yoke is transferred to the concrete element.

2. The tube mill of claim 1, wherein the concrete element is made of a plurality of segments.

3. The tube mill of claim 1, wherein the concrete element is embodied in one piece.

4. The tube mill of claim 1, wherein the concrete element is disposed so as to run around at least three-quarters of the circumference of the stator yoke.

5. The tube mill of claim 1, wherein the concrete element is disposed so as to run around the entire circumference of the stator yoke.

6. The tube mill of claim 1, wherein the concrete element is spaced from the axis of rotation by a constant distance in a radial direction.

7. The tube mill of claim 1, wherein the concrete element has ducts for cooling the electric motor.

8. The tube mill of claim 1, wherein the electric motor has a power output of greater than 5 MW.

* * * * *

UNITED STATES PATENT AND TRADEMARK OFFICE

CERTIFICATE OF CORRECTION

PATENT NO. : 9,233,373 B2
APPLICATION NO. : 13/981566
DATED : January 12, 2016
INVENTOR(S) : Horst Kümmlee, Peter Petereit and Frank Seibicke It is certified that error appears in the above-identified patent and that said Letters Patent is hereby corrected as shown below:

On the title page, column two, under FOREIGN PATENT DOCUMENTS, correct "CM 1539191 A" to read --CN 1539191 A--.

Signed and Sealed this
Nineteenth Day of April, 2016

Michelle K. Lee

Michelle K. Lee
*Director of the United States Patent and Trademark Office*